US009080235B2

(12) United States Patent
Chunyayeva et al.

(10) Patent No.: US 9,080,235 B2
(45) Date of Patent: Jul. 14, 2015

(54) COMPOSITION AND METHOD FOR DIFFUSION ALLOYING OF FERROCARBON WORKPIECE

(75) Inventors: Lidiya Omovna Chunyayeva, Kharkov (UA); Oleg Nikolayevich Chunyayev, Kharkov (UA); Leonid Leonidovich Tovazhnyanskyy, Kharkov (UA)

(73) Assignee: JAMAR INTERNATIONAL CORPORATION, Cincinnati, OH (US)

( * ) Notice: Subject to any disclaimer, the term of this patent is extended or adjusted under 35 U.S.C. 154(b) by 438 days.

(21) Appl. No.: 13/448,445

(22) Filed: Apr. 17, 2012

(65) Prior Publication Data

US 2013/0269837 A1 Oct. 17, 2013

(51) Int. Cl.

| | |
|---|---|
| ***C23C 10/32*** | (2006.01) |
| ***C23C 10/38*** | (2006.01) |
| ***C23C 10/40*** | (2006.01) |
| ***C23C 10/60*** | (2006.01) |
| *C23C 30/00* | (2006.01) |

(52) U.S. Cl.

CPC ..... *C23C 10/32* (2013.01); *C23C 10/38* (2013.01); *C23C 10/40* (2013.01); *C23C 10/60* (2013.01); *C23C 30/00* (2013.01)

(58) Field of Classification Search

CPC ..... C23C 10/32; C23C 10/34; C23C 10/36; C23C 10/38; C23C 10/40; C23C 30/00

See application file for complete search history.

(56) References Cited

U.S. PATENT DOCUMENTS

| | | | |
|---|---|---|---|
| 4,028,052 | A | 6/1977 | Verhoeven et al. |
| 4,042,426 | A | 8/1977 | Beiser |
| 4,099,993 | A | 7/1978 | Muller et al. |
| 4,306,905 | A | 12/1981 | Pahlman et al. |
| 4,441,921 | A | 4/1984 | Curr et al. |
| 4,662,840 | A | 5/1987 | Ellison |
| 4,963,395 | A | 10/1990 | Lewis et al. |
| 4,966,547 | A | 10/1990 | Okuyama et al. |
| 5,939,144 | A | 8/1999 | Zayets et al. |
| 5,958,152 | A | 9/1999 | Nakahama et al. |
| 5,972,429 | A | 10/1999 | Bayer et al. |
| 6,116,894 | A | 9/2000 | Kolln et al. |
| 6,197,436 | B1 | 3/2001 | Zayets et al. |
| 6,537,388 | B1 | 3/2003 | Wynns et al. |
| 6,602,550 | B1 | 8/2003 | Grant et al. |
| 6,725,911 | B2 | 4/2004 | Jayaweera et al. |
| 2006/0134453 | A1 | 6/2006 | Kuwabara et al. |

FOREIGN PATENT DOCUMENTS

| | | |
|---|---|---|
| DE | 42 38 220 | 5/1993 |
| GB | 1070158 | 5/1967 |
| WO | WO 98/18978 | 5/1998 |
| WO | WO 03/064723 | 8/2003 |
| WO | WO 03/064949 | 8/2003 |

OTHER PUBLICATIONS

International Search Report and Written Opinion, PCT/US2013/036707, Jamar International Corporation, dated Jun. 3, 2014, 12 pages.

Chunyaeva, L. O., Pitting Resistance of Diffusion-Alloyed Carbon Steels, Materials Science, Sep.-Oct. 2004, pp. 113-115, vol. 40, No. 5. (Abstract with cover page—2 pages total).

*Primary Examiner* — Lois Zheng

(74) *Attorney, Agent, or Firm* — Hasse & Nesbitt LLC; Donald E. Hasse

(57) ABSTRACT

A composition for diffusion surface alloying of ferrocarbon alloys with chromium, consisting essentially of, by weight, about 25%-40% ferrochromium; about 54%-74% aluminum oxide or mixtures of aluminum oxide, silicon oxide and magnesium oxide in a weight ratio of about 3:2:1; about 1%-3% ammonium chloride; and a reducing agent consisting essentially of about 0.1%-3% aluminum, about 0.1%-2% silicon, about 0.1%-1.5% magnesium, or about 0.1%-3% of a mixture of aluminum, silicon and magnesium in a weight ratio of about 3:2:1. A method for diffusion surface alloying of a ferrocarbon workpiece with chromium, comprising providing the above composition; exposing the workpiece to the composition; and heating the workpiece and composition for sufficient time and temperature to form a chromium containing diffusion layer on the surface of the workpiece.

6 Claims, No Drawings

COMPOSITION AND METHOD FOR DIFFUSION ALLOYING OF FERROCARBON WORKPIECE

TECHNICAL FIELD

The invention relates to the protection of ferrocarbon alloys against corrosion and wear. In particular, the invention relates to the diffusion surface alloying of ferrocarbon workpieces with chromium and to diffusion carbide surface alloying (DCSA) of ferrocarbon workpieces with chromium. The invention is applicable to the machine-building, mining, oil-processing and chemical industries, and can be utilized by companies that specialize in heat treatment and chemo-thermal treatment of metal parts and rolled iron.

BACKGROUND OF THE INVENTION

One of the difficulties in diffusion surface alloying using powdered mixtures is the rapid exhaustion of the saturating mixtures. This can lead to undesirable consequences as the number of cycles using the alloying mixture increases: the repeatability of the alloying results may suffer; the integrity and uniformity of the surface protective layer may deteriorate on workpieces with minor surface defects, such as traces of corrosion or oxidation; the thickness of the diffusion layer may decrease; the concentration of the main alloying element in the diffusion layer may decrease; and the cost of treatment may increase due to the periodic need to replace the exhausted saturating mixture with a new composition. Another disadvantage of existing compositions relates to the waste of a large portion (up to 90%) of the main alloying element present in a saturating mixture that has lost its activity. In addition to the above, the use of existing compositions may lead to lost production time because it is much more difficult to prepare a new saturating mixture than to correct the composition of an existing one before it loses its activity.

There are several types of compositions for diffusion surface alloying and diffusion carbide surface alloying of ferrocarbon workpieces with chromium:

A) Compositions that contain chromium, aluminum oxide, and ammonium halide (typically chloride), for example, chromium 50%, aluminum oxide 43-45%, and ammonium chloride 5-7%.

B) Compositions that contain ferrochromium, aluminum oxide, and ammonium halide, for example, ferrochromium 70%, aluminum oxide 29%, and ammonium chloride 1%.

C) Compositions similar to A) and B) that contain microadditives, such as tantalum, vanadium, molybdenum, boron, silicon, tantalum carbide or silicon carbide, to modify the diffusion layer on workpieces being alloyed. Such microadditives may also act as a reducing agent for the main component of the mixture and for surfaces of workpieces being alloyed. For example, a composition C)(1) contains chromium 50-60%, tantalum carbide 0.75-2.5%, aluminum oxide 34.5-48.25%, and ammonium chloride 1-3%.

D) Compositions that contain chromium oxide, aluminum, aluminum oxide and ammonium chloride, for example, chromium oxide 60%, aluminum 12%, aluminum oxide 25%, and ammonium chloride 3%.

E) Compositions similar to A) and B) but with the addition of a reducing agent such as magnesium to stabilize the alloying results, for example, chromium 65%, aluminum oxide 30%, magnesium 4.5%, and ammonium chloride 0.5%.

F) Compositions that produce mixed chromium-silicon diffusion layers, for example, ferrochromium 25%, aluminum oxide 71%, ferrosilicon 2%, ammonium chloride 1%, and calcium fluoride 1%.

When compositions such as A), B) and C) above are used over multiple cycles (5-10 cycles, sometimes 15-30 cycles), one may periodically add 1-5% ammonium chloride and 20% of the initial composition to replenish the used composition. For example, such an additive or correction composition may be added every fifth working cycle (firing) of the saturating mixture. However, the repeatability of alloying results may still deteriorate as the number of working cycles increases.

As shown in Table 1, the activity of the above composition C)(1), corrected by adding 1-5% ammonium chloride and 20% of the initial composition every fifth working cycle, falls after the tenth working cycle. The fall in activity can be seen from the gradual decline in the surface chromium concentration, a reduction in microhardness and a reduced corrosion potential. The reduced carbon concentration in the carbide layer is believed to be caused by the composition's lost reducing ability in relation to chromium and iron. The activity of compositions such as A) and B) over multiple cycles typically falls even more rapidly.

While a composition such as F) above has the ability to deposit two alloying elements (Cr and Si) simultaneously, which may be beneficial for hot gas corrosion resistance, it is unacceptable for applications where chromium should be the single alloying element in the diffusion layer, for example, marine corrosion applications and abrasion wear applications where a pure chromium carbide layer (such as $Cr_7C_3$) provides superior properties compared to a mixed chromium-silicon diffusion layer.

Thus, there is a continuing need for improved compositions and methods for diffusion surface alloying and diffusion carbide surface alloying of ferrocarbon workpieces.

SUMMARY OF THE INVENTION

The present invention relates to a composition for diffusion surface alloying of a ferrocarbon workpiece with chromium, consisting essentially of, by weight: from about 25% to about 40% of ferrochromium; from about 54% to about 74% of aluminum oxide or mixtures of aluminum oxide, silicon oxide and magnesium oxide in a weight ratio of about 3:2:1; from about 1% to about 3% of ammonium chloride; and a reducing agent consisting essentially of from about 0.1% to about 3% of aluminum, from about 0.1% to about 2% of silicon, from about 0.1% to about 1.5% of magnesium, or from about 0.1% to about 3% of a mixture of aluminum, silicon and magnesium in a weight ratio of about 3:2:1.

The invention also relates to a composition for diffusion surface alloying of a ferrocarbon workpiece with chromium, consisting essentially of, by weight: a chromium containing component consisting essentially of from about 1% to about 10% of ferrochromium, from about 0.5% to about 5% of chromium, or from about 1.5% to about 15% of ferrosilicochromium; from about 0.2% to about 1% of ammonium chloride or chromium dichloride; a reducing agent consisting essentially of from about 0.1% to about 3% of aluminum, from about 0.1% to about 2% of silicon, from about 0.1% to about 1.5% of magnesium, or from about 0.1% to about 3% of a mixture of aluminum, silicon and magnesium in a weight ratio of about 3:2:1; and the balance being the remaining portion of the composition described in the above paragraph after it has been used for diffusion surface alloying of a ferrocarbon workpiece.

The invention also relates to a method for diffusion surface alloying of a ferrocarbon workpiece with chromium, comprising:

(1) providing a composition consisting essentially of, by weight:

a) from about 25% to about 40% of ferrochromium;

b) from about 54% to about 74% of aluminum oxide or mixtures of aluminum oxide, silicon oxide and magnesium oxide in a weight ratio of about 3:2:1;

c) from about 1% to about 3% of ammonium chloride; and d) a reducing agent consisting essentially of from about 0.1% to about 3% of aluminum, from about 0.1% to about 2% of silicon, from about 0.1% to about 1.5% of magnesium, or from about 0.1% to about 3% of a mixture of aluminum, silicon and magnesium in a weight ratio of about 3:2:1;

(2) exposing the workpiece to the composition; and (3) heating the workpiece and the composition for sufficient time and temperature to form a chromium containing diffusion layer on the surface of the workpiece.

The invention further relates to a method for diffusion surface alloying of ferrocarbon workpieces with chromium, comprising:

(1) providing a composition consisting essentially of, by weight:

a) from about 25% to about 40% of ferrochromium;

b) from about 54% to about 74% of aluminum oxide or mixtures of aluminum oxide, silicon oxide and magnesium oxide in a weight ratio of about 3:2:1;

c) from about 1% to about 3% of ammonium chloride; and d) a reducing agent consisting essentially of from about 0.1% to about 3% of aluminum, from about 0.1% to about 2% of silicon, from about 0.1% to about 1.5% of magnesium, or from about 0.1% to about 3% of a mixture of aluminum, silicon and magnesium in a weight ratio of about 3:2:1;

(2) exposing a first workpiece to the composition;

(3) heating the first workpiece and the composition for sufficient time and temperature to form a chromium containing diffusion layer on the surface of the workpiece;

(4) cooling and removing the first workpiece from the remaining portion of the composition;

(5) providing a corrected composition consisting essentially of, by weight:

a) a chromium containing component consisting essentially of from about 1% to about 10% of ferrochromium, from about 0.5% to about 5% of chromium, or from about 1.5% to about 15% of ferrosilicochromium;

b) from about 0.2% to about 1% of ammonium chloride or chromium dichloride;

c) a reducing agent consisting essentially of from about 0.1% to about 3% of aluminum, from about 0.1% to about 2% of silicon, from about 0.1% to about 1.5% of magnesium, or from about 0.1% to about 3% of a mixture of aluminum, silicon and magnesium in a weight ratio of about 3:2:1; and d) the balance being the remaining portion of the composition from step (4);

(6) exposing a second workpiece to the corrected composition;

(7) heating the second workpiece and the corrected composition for sufficient time and temperature to form a chromium containing diffusion layer on the surface of the second workpiece; and (8) cooling and removing the second workpiece from the remaining portion of the corrected composition.

DETAILED DESCRIPTION OF THE INVENTION

The present invention provides a composition for diffusion surface alloying and diffusion carbide surface alloying of ferrocarbon workpieces with chromium. The composition can be used for a large number of alloying or working cycles with the implementation of regular correction or replenishment of the three main components used in the method: 1) the main alloying element chromium; 2) chlorine in the form of chloride; and 3) the reducing agent.

While not intending to be limited by theory, it is believed that regular correction or replenishment of the three main components of the alloying mixture is necessary because the chromium is continuously spent to form the diffusion layer on the workpieces being treated; a portion of the chlorine is regularly spent with the gases that escape the reactor; and the reducing agent is spent during each firing cycle to reduce oxidation films on the workpieces and mixture particles, and also to bind oxygen from the reaction gas in the reactor. The invention allows reuse of the alloying composition over a large number of working cycles, thereby decreasing the expenditure of expensive alloying elements, saving resources and improving the economic effectiveness of the alloying method.

Compared to prior compositions for diffusion surface alloying and diffusion carbide surface alloying of ferrocarbon workpieces with chromium, in the initial saturating mixture, the content of the main alloying component is decreased and a reducing reagent is added. Thereafter, during the cyclic use of the composition, corrections are regularly implemented, typically after each working or firing cycle. The correction composition contains three main components: 1) a chromium containing component (chromium, ferrochromium or ferrosilicochromium); 2) a chlorine containing component (ammonium chloride or chromium dichloride); and 3) a reducing reagent (aluminum, silicon or magnesium, or a mixture thereof). The balance of the composition is the remaining portion of the previously used alloying composition.

The composition of the first work cycle consists essentially of, by weight: from about 25% to about 40% of ferrochromium; from about 54% to about 74% of aluminum oxide or mixtures of aluminum oxide, silicon oxide and magnesium oxide in a weight ratio of about 3:2:1; from about 1% to about 3% of ammonium chloride; and a reducing agent consisting essentially of from about 0.1% to about 3% of aluminum, from about 0.1% to about 2% of silicon, from about 0.1% to about 1.5% of magnesium, or from about 0.1% to about 3% of a mixture of aluminum, silicon and magnesium in a weight ratio of about 3:2:1.

In one embodiment, the composition of the first work cycle consists essentially of, by weight: from about 30% to about 40% of ferrochromium; and from about 54% to about 69% of aluminum oxide or mixtures of aluminum oxide, silicon oxide and magnesium oxide in a weight ratio of about 3:2:1, with the ammonium chloride and reducing agent as described above. In another embodiment the reducing agent consists essentially of from about 0.1% to about 3% of aluminum or from about 0.1% to about 1.5% of magnesium. Such a composition may be particularly useful when it is desirable to exclude significant amounts of silicon from the first cycle composition, particularly when the ferrocarbon workpiece has high attraction to silicon, for example molybdenum and tungsten alloyed steels.

For each subsequent work cycle, the correction composition consists essentially of, by weight: a chromium containing component consisting essentially of from about 1% to about 10% of ferrochromium, from about 0.5% to about 5% of chromium, or from about 1.5% to about 15% of ferrosilicochromium; from about 0.2% to about 1% of ammonium chloride or chromium dichloride; and a reducing agent consisting essentially of from about 0.1% to about 3% of aluminum, from about 0.1% to about 2% of silicon, from about 0.1% to about 1.5% of magnesium, or from about 0.1% to about 3% of a mixture of aluminum, silicon and magnesium in a weight ratio of about 3:2:1. The balance of the corrected composition is the remaining portion of the alloying composition from the previous cycle, i.e., the remaining portion of the composition consisting essentially of, by weight: from about 25% to about 40% of ferrochromium; from about 54% to about 74% of aluminum oxide or mixtures of aluminum oxide, silicon oxide and magnesium oxide in a weight ratio of about 3:2:1; from about 1% to about 3% of ammonium chloride; and a reducing agent consisting essentially of from about 0.1% to about 3% of aluminum, from about 0.1% to about 2% of silicon, from about 0.1% to about 1.5% of magnesium, or from about 0.1% to about 3% of a mixture of aluminum, silicon and magnesium in a weight ratio of about 3:2:1.

While not intending to be limited by theory, it is believed that the addition of more than about 40% ferrochromium to the initial composition does not improve the chromizing ability of the composition, and the use of less than about 25% of ferrochromium does not provide the desired chromium diffusion. Lower levels of the reducing agent in the mixture, for example, about 0.1-0.5%, may be sufficient for use in hermetically sealed reactors or in furnaces having a controlled atmosphere. Higher levels of the reducing agent in the mixture, for example, about 0.6-3%, typically are used in regular reactors that are fired in air.

The level of the components in the correction composition may be selected to solve specific tasks. For example, higher levels of the reducing agent, for example, about 0.5-3%, may be used when there is a need to treat parts having oxidation films. However, the addition of excess amounts of the chromium containing component to the correction composition may lead to its incomplete expenditure during use and thus waste resources and the capacity of the mixture. The addition of lower amounts of the chromium containing component may not replenish the chromium expended during diffusion alloying of workpieces in the previous cycle.

The diffusion surface alloying and diffusion carbide surface alloying of a ferrocarbon workpiece with chromium provides a protective diffusion layer with high performance characteristics. When alloying steels with a carbon content of about 0.2-2.15% and when alloying grey, ductile or high-strength cast iron, the surface microhardness of the carbide layer may reach the range of 1750-2050 HV. The corrosion resistance of the carbide layer formed is also high. It is typically resistant to nitric acid, sulfuric acid, salt fog, halide containing solutions, sea water, plain water and industrial atmospheres. The carbide layer formed may be heat resistant for over 5000 hours of service at temperatures below 800° C., from 1000 to 5000 hours at temperatures of 800-900° C., and from 200 to 1000 hours at temperatures of 900-950° C. When steels containing less than about 0.2% carbon and pure iron and alloys free from active carbon are alloyed using the compositions herein, the diffusion layers formed typically have a surface chromium concentration of from about 35% to 92%. Such diffusion layers may be less hard and corrosion resistant than carbide layers, but typically outperform carbide layers in resistance to oxidation by 15-50%.

The compositions herein for diffusion surface alloying and diffusion carbide surface alloying of ferrocarbon workpieces with chromium are designed mainly for protection of parts made of common grades of steel and cast iron. However, the compositions can also be used for treatment of other metallic alloys, for example, nickel-based alloys and carbon-based materials such as graphite and cemented carbides.

The compositions herein can be prepared and used using known equipment. The components are typically powders of the respective materials, mainly in the form of granules. In the method, the powders are thoroughly mixed and then poured into a reactor or container, typically a hermetically sealed reactor, along with the workpieces to be treated. The reactor is heated in a furnace until it reaches the temperature of diffusion alloying, typically from about 1000° C. to about 1050° C., and typically for from about 1 to about 5 hours. The workpieces are kept in the furnace for the time needed to form the diffusion layer of the desired depth or thickness, typically from about 10 to 200 microns. The reactor is then cooled down. After cool down is complete, the reactor is opened and the treated workpieces are unloaded. The correction composition herein is then added to the previously used or fired composition. The composition with the correction is thoroughly mixed again and is then ready for the next working cycle. The compositions of the invention can be used for a large number of working cycles, for example, 50, 100, 150, or 200 or more cycles. The ability of the Example 1 composition below to provide repeatable alloying results over many cycles is shown in Table 2.

Example 1

A composition of the invention is prepared by mixing powders of the following components (weight %): 35% ferrochromium; 60% of a mixture of aluminum oxide, silicon oxide, and magnesium oxide in a weight ratio of 3:2:1; 3% ammonium chloride; and 2% of a mixture of aluminum, silicon, and magnesium in a weight ratio of 3:2:1.

The composition is thoroughly mixed and poured into a reactor. The parts to be treated, for example, bearing rollers 10 mm in diameter and 10 mm high made of 52100 standard bearing alloy, are placed in the reactor. The reactor is hermetically sealed, heated in a furnace until it reaches a temperature of 1050° C., and then kept in the furnace for 4 hours. After the reactor is cooled down, it is opened and the treated parts are unloaded.

After the first work cycle is completed, a powdered correction composition is added to the alloying composition previously used. The corrected composition contains 5% ferrochromium, 0.5% ammonium chloride, and 2% of a mixture of aluminum, silicon and magnesium in a weight ratio of 3:2:1, with the balance being the remaining portion of the composition previously used. The composition is thoroughly mixed again, and is then ready for treating new parts during the next working cycle. The above method is repeated for the number of working cycles reported in Table 2, after which the parts are analyzed and tested.

TABLE 1

The chromium and carbon concentration on the surface of the carbide layer, the mean surface microhardness and corrosion potential in sea water (at room temperature) of 1070 steel samples treated using the above composition C)(1), corrected by adding 1-5% ammonium chloride and 20% of the initial composition every fifth working cycle, is as follows:

| | Number of cycles | | | | | | | | | |
|---|---|---|---|---|---|---|---|---|---|---|
| | 5 | 10 | 15 | 20 | 25 | 30 | 35 | 50 | 100 | 200 |
| Concentration of Cr % | 86.3 | 84.7 | 81.5 | 80.2 | 74.6 | 73.1 | 68.4 | The repeatability of alloying results is lost. The layer becomes porous and uneven. | | |
| Concentration of C % | 12.8 | 12.0 | 9.4 | 9.0 | 8.2 | 8.4 | 8.1 | | | |
| Microhardness of the carbide layer HV | 1750 | 1680 | 1470 | 1430 | 1390 | 1410 | 1370 | | | |
| Corrosion potential V | 0.28 | 0.22 | 0.08 | 0.01 | −0.04 | −0.05 | −0.07 | | | |

TABLE 2

The chromium and carbon concentration on the surface of the carbide layer, the mean surface microhardness and corrosion potential in sea water (at room temperature) of 1070 steel samples treated using the method and composition of Example 1, corrected as described after each working cycle, is as follows:

| | Number of cycles | | | | | | | |
|---|---|---|---|---|---|---|---|---|
| | 10 | 20 | 30 | 40 | 60 | 80 | 100 | 200 |
| Concentration of Cr % | 85.6 | 84.3 | 83.5 | 84.0 | 82.2 | 83.0 | 85.1 | 83.7 |
| Concentration of C % | 13.1 | 12.9 | 13.2 | 13.0 | 12.9 | 13.3 | 13.8 | 13.5 |
| Microhardness of the carbide layer HV | 1770 | 1750 | 1850 | 1770 | 1730 | 1890 | 1780 | 1800 |
| Corrosion potential V | 0.29 | 0.30 | 0.25 | 0.27 | 0.23 | 0.28 | 0.22 | 0.24 |

The above results demonstrate that the composition of Example 1 retains its high chromium and carbon concentration on the surface of the carbide layer and its high mean surface microhardness and corrosion potential after many cycles.

All parts, percentages and ratios herein are by weight unless otherwise specified.

Various compositions and methods of the invention have been described. However, this disclosure should not be deemed to be a limitation on the scope of the invention. Accordingly, various modifications, adaptations, and alternatives may occur to one skilled in the art without departing from the spirit and scope of the claimed invention.

What is claimed is:

1. A method for diffusion surface alloying of ferrocarbon workpieces with chromium, comprising:

(1) providing a composition consisting essentially of, by weight:

a) from about 25% to about 40% of ferrochromium;

b) from about 54% to about 74% of aluminum oxide or mixtures of aluminum oxide, silicon oxide and magnesium oxide in a weight ratio of about 3:2:1;

c) from about 1% to about 3% of ammonium chloride; and d) a reducing agent consisting essentially of from about 0.1% to about 3% of aluminum, from about 0.1% to about 2% of silicon, from about 0.1% to about 1.5% of magnesium, or from about 0.1% to about 3% of a mixture of aluminum, silicon and magnesium in a weight ratio of about 3:2:1;

(2) exposing a first workpiece to the composition;

(3) heating the first workpiece and the composition for sufficient time and temperature to form a chromium containing diffusion layer on the surface of the workpiece;

(4) cooling and removing the first workpiece from the remaining portion of the composition;

(5) providing a corrected composition consisting essentially of, by weight:

a) a chromium containing component consisting essentially of from about 1% to about 10% of ferrochromium, from about 0.5% to about 5% of chromium, or from about 1.5% to about 15% of ferrosilicochromium;

b) from about 0.2% to about 1% of ammonium chloride or chromium dichloride;

c) a reducing agent consisting essentially of from about 0.1% to about 3% of aluminum, from about 0.1% to about 2% of silicon, from about 0.1% to about 1.5% of magnesium, or from about 0.1% to about 3% of a mixture of aluminum, silicon and magnesium in a weight ratio of about 3:2:1; and d) the balance being the remaining portion of the composition from step (4);

(6) exposing a second workpiece to the corrected composition;

(7) heating the second workpiece and the corrected composition for sufficient time and temperature to form a chromium containing diffusion layer on the surface of the second workpiece; and (8) cooling and removing the second workpiece from the remaining portion of the corrected composition.

2. The method of claim 1 wherein the compositions of steps (1) and (5) are mixtures of powdered components.

3. The method of claim 1 wherein in steps (3) and (7) the workpieces and compositions are heated to a temperature of from about 1000° C. to about 1050° C.

4. The method of claim 3 wherein in steps (3) and (7) the workpieces and compositions are heated for from about 1 to about 5 hours.

5. The method of claim 1 wherein the chromium containing diffusion layer formed on the surface of the workpieces has a thickness of from about 10 to about 200 microns.

6. The method of claim 1 wherein a chromium carbide diffusion layer is formed on the surface of the workpieces.

* * * * *